US006164382A

United States Patent [19]

Schutte et al.

[11] Patent Number: 6,164,382

[45] Date of Patent: Dec. 26, 2000

[54] PYROTECHNICAL DEVICE AND PROCESS FOR EXTINGUISHING FIRES

[75] Inventors: Volker Schutte, Wedemark; Ernst Werner Wagner, Winsen/Aller, both of Germany

[73] Assignee: Wagner Alarm - und Sicherungssysteme GmbH, Langenhagen, Germany

[21] Appl. No.: 09/297,452

[22] PCT Filed: Oct. 30, 1997

[86] PCT No.: PCT/EP97/06013

§ 371 Date: Apr. 30, 1999

§ 102(e) Date: Apr. 30, 1999

[87] PCT Pub. No.: WO98/18524

PCT Pub. Date: May 7, 1998

[30] Foreign Application Priority Data

Oct. 30, 1996 [DE] Germany ..... 196 43 929

[51] Int. Cl.[7] ..... A62C 2/00

[52] U.S. Cl. ..... 169/43; 169/28; 169/35; 169/47; 169/58; 169/59; 169/61

[58] Field of Search ..... 169/43, 47, 56, 169/57, 58, 59, 60, 61, 26, 28, 35, 36; 239/450

[56] References Cited

U.S. PATENT DOCUMENTS

| | | | |
|---|---|---|---|
| 3,482,637 | 12/1969 | Mitchell et al. . | |
| 4,938,293 | 7/1990 | Warren et al. | 169/28 |
| 5,115,867 | 5/1992 | Tyler | 169/28 |
| 5,894,891 | 4/1999 | Rosenstock et al. | 169/28 |

FOREIGN PATENT DOCUMENTS

| | | |
|---|---|---|
| 0488536 | 1/1991 | European Pat. Off. . |
| 195 00 477 | 10/1995 | Germany . |
| 2294105 | 10/1995 | United Kingdom . |

*Primary Examiner*—Andres Kashnikow
*Assistant Examiner*—Robin O. Evans
*Attorney, Agent, or Firm*—Volpe and Koenig, P.C.

[57] ABSTRACT

A device and a method for explosive quenching of fires are indicated, for example forest and area fires. The quenching device contains two flexible hoses (1, 2) disposed next to one another and transversely to the direction of risk (5), and closable at both ends, for accommodating quenching agents, and in each case an explosive (3, 4) in or on the hoses (1, 2) atomizes the quenching agent by its ignition to form a mist, which is applied to the fire. In order to achieve a directed ejection of the quenching agent in the direction of the area of risk, the pulse ($I_1$) which emerges from the first hose (1) facing way from the area of risk is greater than the pulse (I2) emerging from the second hose (2) facing the area of risk. For differing hose diameters, dimensioning of the quantities of explosive in relation to the diameter of the associated hose is effected taking into account the density (of the quenching agent according to a formula according to the invention.

17 Claims, 2 Drawing Sheets

PYROTECHNICAL DEVICE AND PROCESS FOR EXTINGUISHING FIRES

DESCRIPTION

Figure 1:
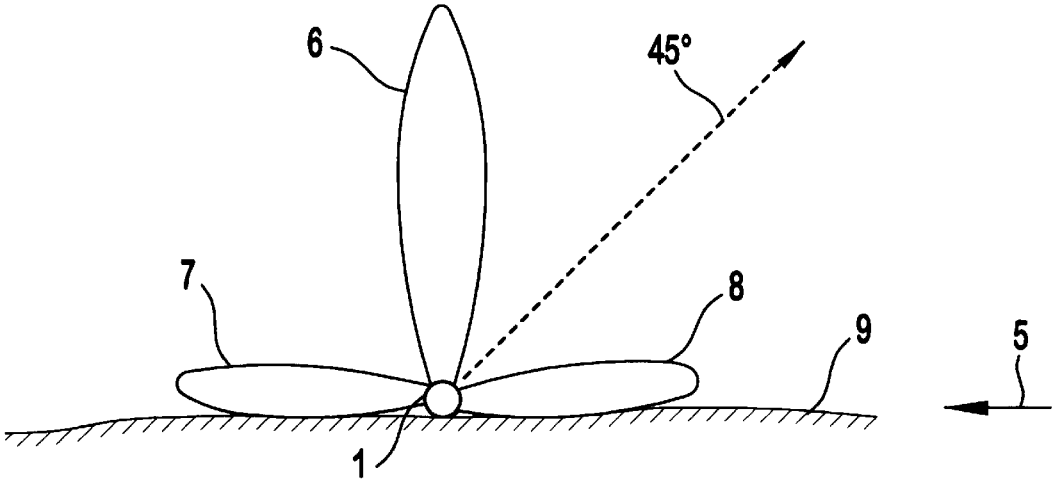
FIG. 1 PRIOR ART

The present invention relates to a device for explosive quenching of fires, with two flexible hoses disposed next to one another and transversely to the direction of danger, and closable at both ends, both filled with a first and a second quenching agent, and each with an explosive material in or on the hoses, by means of ignition of which in each case a pulse is generated and the quenching agent is atomised to form a mist and applied to the fire. The invention further relates to a method of explosive quenching of fires with the device described.

Both such a device and such a method for explosive quenching of fires is for example known from DE 195 00 477 C1. The principle of explosive quenching is based on the fact that during detonation of the explosive material within or in the vicinity of a homogeneous medium in the form of a quenching agent, an extremely high pressure is built up, so that, for example, a compressive shock runs through the water in the hose, which imparts to it an enormous impulse, atomizes it into the finest particles and throws it from the center of the explosive charge symmetrically into the environment. The advantage of atomization of a preferably aqueous quenching agent resides in the extremely highly effective quenching agent surface area in proportion to the quantity of quenching agent used.

The disadvantages of the device and the corresponding method known from DE 195 00 477 C1 reside in the unsatisfactory distribution of the quenching agent in the environment of the explosive hose upon detonation of the explosive charge. It has become apparent that when one single explosive hose is used, the quenching agent is distributed roughly uniformly into one vertical lobe and one left-hand and one right-hand horizontal lobe, with practically no delivery of quenching agent taking place at an angle of 45° to the ground surface. The delivery of quenching agent at a 45° angle is, however, highly desirable in order to achieve an effective range and optimum surface coverage.

The utilisation of two explosive hoses disposed parallel next to one another has no effect on the disadvantage of an unsatisfactory spray characteristic at a 45° angle to the ground surface. Only the height and the volume of the vertical lobe are considerably increased.

The present invention applies itself to this problem, the object of which is seen to be further to develop both the already mentioned device known from DE 195 00 477 C1 for explosive quenching of fires, and further to develop the corresponding method, so that a concentrated delivery of quenching agent in the direction of danger is possible with satisfactory penetration of space and surface coverage.

In achieving the set object, the device for explosive quenching of fires of the type already mentioned is designed according to the invention in that the pulse from the first hose facing away from the direction of risk is at least twice as great as the pulse of the second hose facing the direction of risk.

By the pulse of a body is known to be understood the product of its mass and its velocity. Furthermore, the density identifies the ratio of the mass of a body to its volume. Thus, the pulse imparted to the quenching agent by the detonation is dependent on the volume and the density of the quenching agent and on the size of the explosive charge which ensures the velocity of the quenching agent particles. The alignment of the range of quenching agent towards the area of risk and the desired ejection characteristic is thus achieved in that the product of mass and velocity of the quenching agent of the first explosive hose which, seen from the area of risk, lies behind the second explosive hose, imparts a larger pulse to the quenching agent in the second hose, than the latter has obtained by its own explosive charge, resulting in a deviation of the main mass of the quenching agent into the direction of danger by means of superimposition of pulses.

The object underlying the invention is further achieved by a method adapted to the device according to the invention, in which the essential factor is that the explosives of the first and of the second hose are ignited simultaneously, in order to achieve the superimposition of pulses described above.

Both the device according to the invention and the method have a series of advantages, which again considerably increase the efficiency during explosive quenching of fires. On the one hand there resides in an advantage in the aimed ejection of the quenching agent itself, so that a more efficient utilisation of the quenching agent used can be achieved. In the known device and in the corresponding method, the quenching agent is emitted disadvantageously symmetrically to both sides of the explosive hose or hoses, and in addition the horizontal lobes of the quenching agent are disposed in such a flat manner over the ground surface that the efficiency of the use of quenching agent is extremely unsatisfactory. In the embodiments according to the invention the quenching agent is emitted asymmetrically in the direction of the area of risk and at an optimum angle to the ground surface, so that also an optimum distribution and range of the quenching agent is achieved. As a further advantage, by selection of one larger and one smaller explosive hose, the quantity of quenching agent not emitted in the direction of the area of risk is kept low.

Advantageous further developments of the device according to the invention are given in claims 2 to 5, and of the method according to the invention in claims 7 and 8.

Experimental tests have shown that the proportional number $\lambda$, which indicates the proportion of the impulse $I_1$ of the first hose to the impulse $I_2$ of the second hose and can be shown by the formula $$\frac{I_1}{I_2} = \lambda = \frac{(d_1\sqrt{q_1 \cdot p_1})}{(d_2\sqrt{q_2 \cdot p_2})}$$

(d=hose diameter, q=quantity of explosive, ρ=density of quenching agent) must be at least equal to 2 in order to achieve a satisfactory directional effect. To this extent, in a first further development of the device according to the invention, the pulse $I_1$ emitted by the first hose is roughly twice as great as the pulse $I_2$ emitted from the second hose. It has already been explained in the preceding that the pulse imparted to the quenching agent by detonation of the explosive charge with respect to the present invention gives substantially a function of the diameter of the hose in which the quenching agent is accommodated, further the density of the quenching agent, and finally the size of the explosive charge, expressed by the quantity of explosive q. As for example explosive cords as preferably used at present, are obtainable in Germany only in commercially available sizes of 12, 20, 40 or 100 g/m, in order to optimize the use of quenching agent it becomes necessary to co-ordinate with one another the diameter of the hoses used, the size of the explosive charge and the type of quenching agent used. The quenching agent for example can consist of pure water with the known density 1, or of a pre-foamed quenching agent with a substantially lower density.

Taking these factors into account, a further development of the device for explosive quenching of fires with a first explosive hose with a first diameter and a first quenching agent with a first density, and with a second explosive hose with a second diameter and a second quenching agent with a second density brings about the desired directional characteristic of the ejection of quenching agent in that the quantity of explosive, the diameter and the density of the quenching agent of the first hose facing away from the area of risk in relation to the quantity of explosive, the diameter and the density of quenching agent of the second hose facing the area of risk behave according to the formula $$\frac{q_1}{q_2} \approx 4 \cdot \left(\frac{d_2}{d_1}\right)^2 \cdot \frac{\rho_2}{\rho_1}$$

As a result of this further development, the device according to the invention permits any combinations of size of the two explosive hoses with specific compositions of quenching agent, for which, according to the formula given, a good approximation of the necessary quantities of explosive can be calculated. Otherwise expressed, when using explosive cords in commercially available discrete sizes, i.e. with a predetermined quantity of explosive, the corresponding hose diameters can be determined taking into account the composition of the quenching agent. Finally, it is possible with this further development to fill an explosive hose with pre-foamed quenching agent instead of pure water, so that the water requirement can be considerably reduced. This is of great advantage particularly in inaccessible places, for example in the case of forest fires.

The second hose facing the area of risk preferably has a larger diameter than that of the first hose facing away from the area of risk. The background of this further development is that the second hose which is located closer to the potential or existing seat of fire, functions predominantly as a delivery system for quenching agent, while the other (first) hose substantially acts as a pulse emitter. It has also been shown experimentally that it is sufficient if the second hose facing the area of risk, which predominantly operates as a delivery system for quenching agent, is provided with a smaller explosive cord, which substantially only has the purpose of bursting the second explosive hose simultaneously with ignition of the explosive cord of the first hose.

To this extent, a further development of the invention provides that the quantity of explosive of the first hose is greater than the quantity of explosive of the second hose. In a particularly preferred way, the first quenching agent in the first hose is water, and the second quenching agent in the second hose is a mixture of water and a quenching additive, so that environmental stress and costs due to the quenching agent additive can be kept as low as possible. The quenching additive can for example be a pure foam former or a so-called "retarder". By a retarder is meant either salts, which penetrate into the pores of the burning material and therefore prevent its exhalation, or thickening gels, which are applied in the manner of a protective coating on the burning material and thus smother the fire.

In further development of the method according to the invention, according to which the pulse emitted by the first hose must be greater than the pulse emitted from the second hose, it is once again provided that the magnitude substantially determining the pulse, namely the quantity of explosive, the diameter and the density of the quenching agent of the explosive hoses, are dimensioned according to the already-mentioned formula $$\frac{q_1}{q_2} \approx 4 \cdot \left(\frac{d_2}{d_1}\right)^2 \cdot \frac{\rho_2}{\rho_1}$$

and that the explosives of the first and of the second hose (1, 2) are ignited simultaneously.

In order to use the quenching device or to apply the method for preventative fire protection on stationary installations, ignition of the explosive is preferably effected on the basis of a signal from a device for early recognition of fire. In this case there are meant by the term "stationary installations" for example oil or gas tanks, refineries, oil drilling or transporting installations, storage spaces, airport take-off and landing strips, or aircraft parking areas, without this enumeration being exhaustive.

Figure 2:
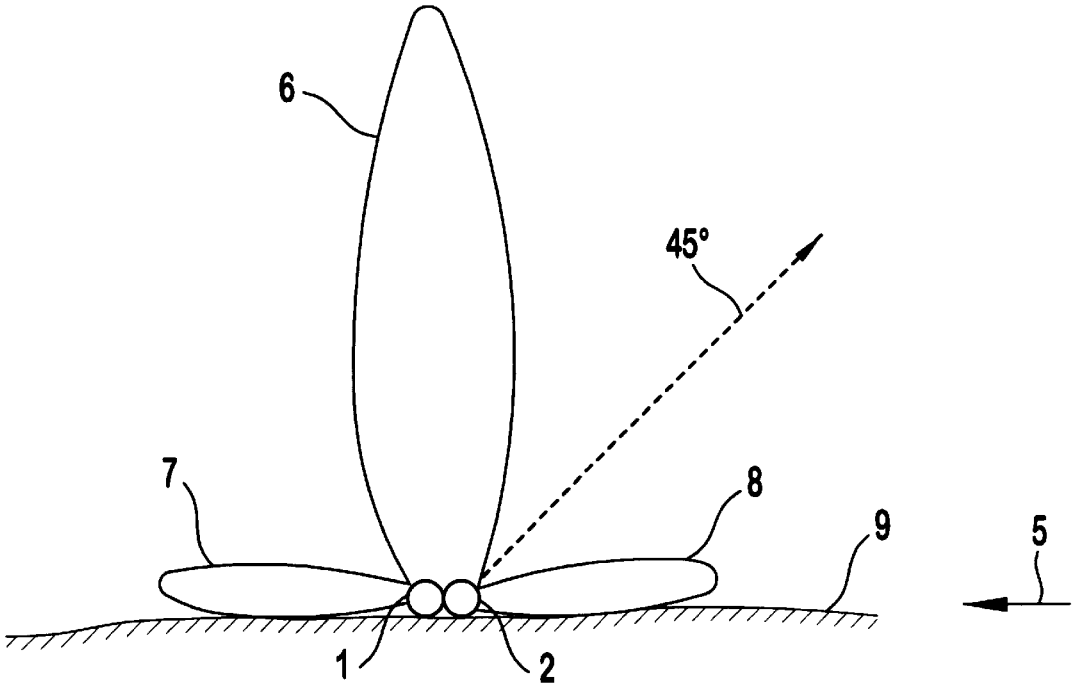
FIG. 2 PRIOR ART
Figure 3:
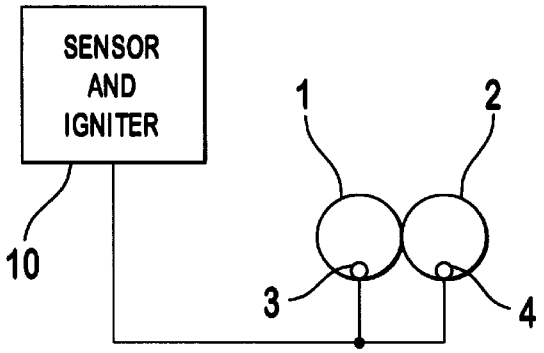
Figure 4:
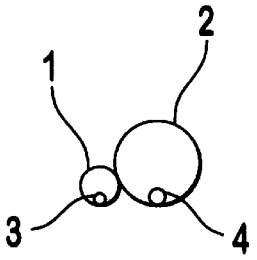
Figure 5:
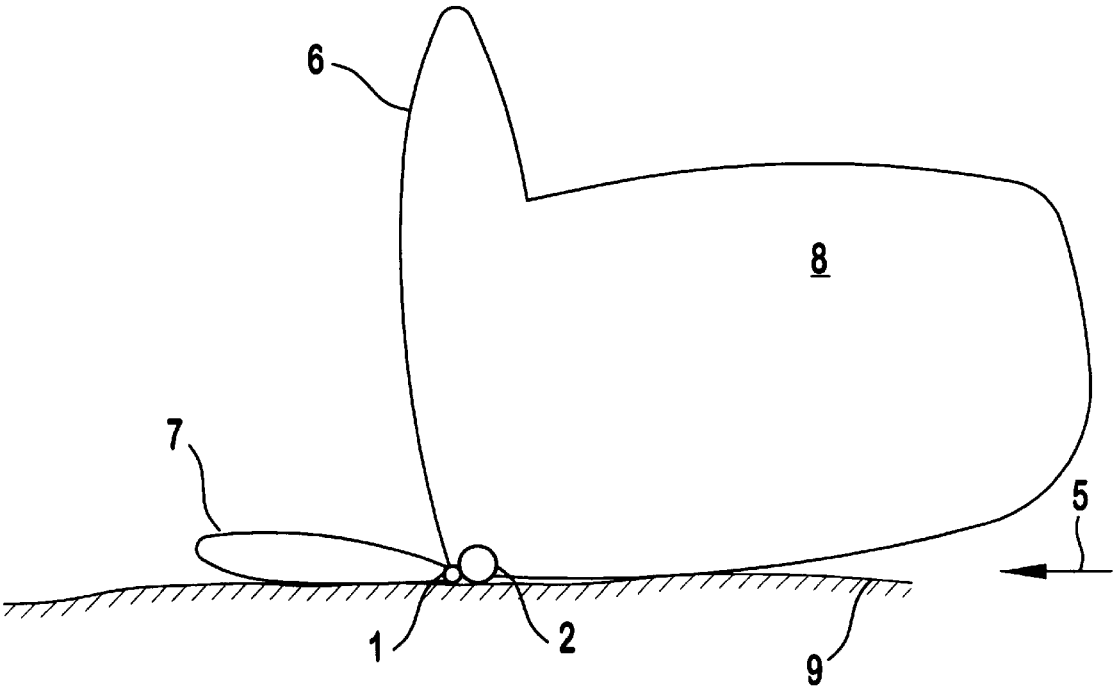

A device for early recognition of fire includes a sensor by means of which the presence of a fire parameter such as smoke or the like is recognised in the earliest stage of initiation of a fire, and leads to triggering off an alarm. In the following, two embodiments given by way of example of the device according to the invention and the corresponding method will be explained in more detail with reference to a drawing. Shown are:

FIG. 1: a schematic view of the explosive diagram with a single hose according to prior art;

FIG. 2: a schematic view of the explosive diagram with two explosive hoses according to prior art lying next to one another;

FIG. 3: a schematic view of two explosive hoses in explanation of the first embodiment according to the invention;

FIG. 4: a schematic view of two hoses with differing diameters in explanation of the second embodiment according to the invention; and FIG. 5: a schematic view of the explosive diagram according to the second embodiment according to the invention.

FIGS. 1 and 2 show shematically the explosive diagrams during use of a single explosive hose 1 and of two explosive hoses 1, 2 disposed in parallel next to one another according to prior art. A common factor in both explosive diagrams is that the distribution of the quenching agent is symmetrical to both sides of the explosive hose or hoses. In each case a vertical lobe 6 and a left-hand horizontal lobe 7 and a right-hand horizontal lobe 8 are formed. The horizontal lobes 7, 8 are located flat above the ground 9.

It is clearly recognisable that in both explosive diagrams there is no emission of quenching agent at a 45° angle to the ground 9. The only difference between the explosive diagrams of FIGS. 1 and 2 resides in the fact that the vertical lobe 6 when two explosive hoses 1, 2 are used is considerably higher and of larger volume than when one single hose according to FIG. 1 is used. The lack of ejection of quenching agent at a 45° angle to the ground 9, recognisable in the explosive diagrams, and the low distribution of the horizontal lobes 7, 8 results in an efficient and unsatisfactory use of quenching agent. For a surface covering and wide ejection of quenching agent in the direction of danger 5, deflection of the main mass of the quenching agent at an angle of 45° to the ground 9 is highly desirable.

FIG. 3 shows a schematic view of two identical explosive hoses 1, 2: disposed parallel and next to one another. The hoses are filled with a quenching agent closed at both ends. An explosive 3, 4 in the form of a flexible explosive cord is disposed in each hose 1, 2. The explosive cords are connected to a sensor and igniter device 10, by means of which ignition of the explosive charge is effected, so that the quenching agent is atomized to form a mist and applied to the fire. In order to achieve a directed ejection of quenching agent upon detonation of the explosive, in this first embodiment of the device according to the invention, the quantity of explosive q1 of the first hose 1 facing away from the area of risk is greater than the quantity of explosive q2 of the second hose 2 facing the area of risk (with reference to FIGS. 3 and 4, the area of risk is on the right). Thus a larger impulse is emitted from the first hose than from the second hose, which leads to the desired directional effect in the case of the superimposition of pulses caused by the explosion of both hoses.

FIG. 4 shows a similar schematic view of two explosive hoses 1, 2 as in FIG. 3, in this case the explosive hose 1, in order to explain the second embodiment of the invention, having a smaller diameter than the explosive hose 2. Further, the first hose 1 contains a first quenching agent in the form of pure water, while the second hose contains a second quenching agent in the form of a pre-foamed mixture of water and a quenching additive. Here also both hoses 1, 2 are each equipped with a flexible explosive cord 3, 4, which extends through the entire length of the explosive hoses 1, 2. In this embodiment of the device according to the invention, i.e. in the case of explosive hoses with differing diameters ($d_1$ $d_2$), the quantity of explosive/$q_1$, the diameter $d_1$ and the density of quenching agent $\rho_1$ of the first hose 1 facing away from the area of risk (on the right in FIG. 4) with respect to the quantity of explosive $q_2$, to the diameter $d_2$ and to the density of quenching agent $\rho_2$ of the second hose facing the area of risk behave according to the formula $$\frac{q_1}{q_2} \approx 4 \cdot \left(\frac{d_2}{d_1}\right)^2 \cdot \frac{\rho_2}{\rho_1}$$

By means of this formula a good approximation of the ratios of explosive charge/hose diameter/density of quenching agent can be calculated for the use of two explosive hoses 1, 2 disposed parallel next to one another with the objective of achieving a directed ejection of the quenching agent upon detonation of the explosive. The following approximative values may be named as an example for the configuration of the explosive hoses 1, 2 according to the formula named above:

$d_1$=14 cm;
$q_1$=100 g/m;
$d_2$=18 cm;
$q_2$=12 g/m.

In the case of these exemplary values an ejection of quenching agent focused on the area of risk is achieved, insofar as hose 1 is the one which is facing away from the area of risk and hose 2 is the one facing the area of risk.

FIG. 5 shows a schematic view of an explosive diagram as achievable with the second embodiment according to the invention. In this example the first hose 1 facing away from the area of risk has a smaller diameter than the second hose 2 facing the area of risk. In accordance with the above named formulae the hose 1 is however provided with a considerably larger explosive charge for this purpose. The result in the explosive diagram is a greatly increased lobe 8 of quenching agent, directed towards the right towards the direction of risk, which is generated by a superimposition of pulses of the quenching agent thrown out from the two explosive hoses 1, 2. The lobe 8 of quenching agent is a mixture of the vertical lobe 6 and the pure horizontal lobe 8 according to FIG. 2 and throws the main mass of the quenching agent to the right-hand side towards the direction of risk 5. In comparison therewith the left-hand horizontal lobe 7 has remained small, which likewise indicates an extremely directed and efficient use of quenching agent.

The method according to the invention will be explained again now with reference to FIG. 5.

The two flexible hoses 1, 2, closable at both ends, of which the hose 1 has a first diameter $d_1$ and the second hose a second diameter $d_2$, are laid out transversely to the direction of risk and parallel to one another in front of an area of risk, from which a risk of fire emerges in the direction of arrow 5. Then the hoses 1, 2 are each fitted with a flexible explosive cord 3, 4 and each filled with a quenching agent and closed at the ends. The explosive cords 3, 4 are connected in a way not shown here to an igniter device. By means of detonating the explosive cords 3, 4 the quenching agents contained in the hoses 1, 2 are atomized to form a mist and applied to the fire. By generating pulses of differing sizes in both hoses 1, 2, a directed ejection of quenching agent is achieved. In the explosive diagram shown in FIG. 5 the smaller hose 1 was fitted with a larger quantity of explosive than the larger hose 2. Finally, the explosive cords of the first and of the second hose 1, 2 were simultaneously ignited, so that a superimposition of pulses resulted.

What is claimed is:

1. A device for explosive quenching of fires comprising a first flexible hose (1) and a second flexible hose (2) disposed next to one another and transversely to the direction of risk (5), wherein each hose is closable at both ends, filled, respectively, with a first and a second quenching agent, and each hose equipped with an explosive (3, 4) such that, by means of ignition of each explosive, respective first and second pulses ($I_1$, $I_2$) is generated, which atomize the quenching agents to form a mist which is then applied to the fire, characterized in that the first pulse ($I_1$) which emerges from the first hose (1) which faces away from the area of risk is at least twice as great as the second pulse ($I_2$) which emerges from the second hose (2) which faces the area of risk.

2. The device according to claim 1, wherein said first flexible hose (1) has a first diameter ($d_1$) for accommodating the first quenching agent, and wherein said second flexible hose (2) has a second diameter ($d_2$) for accommodating the second quenching agent, characterised in that the quantity ($q_1$) of explosive (3), the diameter ($d_1$) and the density ($\rho_1$) of the quenching agent of the first hose (1) are in relation to the quantity ($q_2$) of explosive (4), the diameter ($d_2$) and the density ($\rho_2$) of the quenching agent of the second hose (2) according to the formula $$\frac{q_1}{q_2} \approx 4 * \left(\frac{d_2}{d_1}\right)^2 * \frac{\rho_2}{\rho_1}$$

3. The device according to claim 1, characterized in that the diameter ($d_2$) of the second hose (2) is larger than the diameter ($d_1$) of the first hose (1).

4. The device according to claim 1, characterized in that the quantity ($q_1$) of explosive (3) of the first hose (1) is greater than the quantity ($q_2$) of explosive (4) of the second hose (2).

5. The device according to claim 1, chareterized in that the first quenching agent is water and the second quenching agent is a water/retarder mixture.

6. The device according to claim 3, characterized in that the quantity ($q_1$) of explosive (3) of the first hose (1) is greater than the quantity ($q_2$) of explosive (4) of the second hose (2).

7. The device according to claim 3, charcterized in that the first quenching agent is water and the second quenching agent is a water/retarder mixture.

8. The device according to claim 3, characterized in that the first quenching agent is water and the second quenching agent is a water/foam mixture.

9. The device according to claim 2, characterized in that the second diameter ($d_2$) of the second hose (2) is larger than the first diameter ($d_1$) of the first hose (1).

10. The device according to claim 2, characterized in that the quantity ($q_1$) of explosive (3) of the first hose (1) is greater than the quantity ($q_2$) of explosive (4) of the second hose (2).

11. The device according to claim 2, charcterized in that the first quenching agent is water and the second quenching agent is a water/retarder mixture.

12. The device according to claim 2, characterized in that the first quenching agent is water and the second quenching agent is a water/foam mixture.

13. The device according to claim 1, characterized in that the first quenching agent is water and the second quenching agent is a water/foam mixture.

14. A method for explosive quenching of fires, comprising the steps of:

laying out a first flexible hose (1) and a second flexible hose (2) transversely to the direction of risk in front of an area of risk, wherein said first hose (1) has a first diameter ($d_1$) and said second hose (2) has a second diameter ($d_2$), wherein each hose is closable at both ends, and each hose is equipped with a quantity ($q_1$, $q_2$) of explosive (3, 4) and each hose is filled, respectively, with first and second quenching agents;

igniting the explosives (3, 4) thereby generating, in each hose, respective first and second pulses ($I_1$, $I_2$);

atomizing the respective quenching agents by means of the respective first and second pulses ($I_1$, $I_2$) to form a mist; and applying the mist to the fire;

characterized in that by means of correspondingly dimensioning the quantity ($q_1$) of explosive (3), the first diameter ($d_1$) and the density of the first quenching agent ($\rho_1$) of the first hose (1) and the quantity ($q_2$) of explosive (4), the second diameter ($d_2$) and the density of the second quenching agent ($\rho_2$) of the second hose (2), the first pulse ($I_1$) generated in the first hose (1) facing away from the area of risk is greater than the second pulse ($I_2$) generated in the second hose (2) facing the area of risk, and in that the explosives of the first and of the second hoses (1, 2) are ignited simultaneously.

15. The method according to claim 14, characterized in that the quantity ($q_1$) of explosive (3), the first diameter ($d_1$) and the density ($\rho_1$) of the first quenching agent of the first hose (1) facing away from the area of risk and the quantity ($q_2$) of explosive (4), the second diameter ($d_2$) and the density ($\rho_2$) of the second quenching agent of the second hose (2) facing the area of risk are dimensioned according to the formula $$\frac{q_1}{q_2} \approx 4 * \left(\frac{d_2}{d_1}\right)^2 * \frac{\rho_2}{\rho_1}$$

and in that the explosives of the first and of the second hoses (1, 2) are simultaneously ignited.

16. The method according to claim 14, serving for preventative fire protection on stationary installations, characterized in that ignition of the explosives (3, 4) is effected on the basis of a signal from a device for early fire detection.

17. The method according to claim 15, serving for preventative fire protection on stationary installations, characterized in that ignition of the explosives (3, 4) is effected on the basis of a signal from a device for early fire detection.

* * * * *